United States Patent [19]

Davis

[11] Patent Number: 4,667,956

[45] Date of Patent: May 26, 1987

[54] GAME OF SKILL

[76] Inventor: Michael S. Davis, 6256 Rogers Park Pl., Cincinnati, Ohio 45213

[21] Appl. No.: 818,002

[22] Filed: Jan. 13, 1986

[51] Int. Cl.[4] ..... A63F 9/00

[52] U.S. Cl. ..... 273/1 GC; 273/1 GG

[58] Field of Search ..... 273/1 GG, 1 GF, 1 G, 273/1 GC

[56] References Cited

U.S. PATENT DOCUMENTS

| | | | |
|---|---|---|---|
| 2,039,121 | 4/1936 | Semple | 273/1 |
| 3,106,039 | 10/1963 | Simpson | 46/47 |
| 3,617,057 | 11/1971 | Goldfarb | 273/1 R |
| 3,687,451 | 8/1972 | Breslow | 273/1 GG |

OTHER PUBLICATIONS

Playthings, 5-1972, p. 37, Jackstraws.

*Primary Examiner*—Paul E. Shapiro

*Attorney, Agent, or Firm*—George P. Brandenburg

[57] ABSTRACT

A game and method of playing same which comprises a plurality of game members and a playing board, is provided such that a number of the game members are used to form a free-stading structure and a remaining game member is used to remove all game members in the structure from the playing board simultaneously without causing any of the members to fall. The game and method of playing is designated to be a game of skill capable of solution within a given time limit.

12 Claims, 7 Drawing Figures

GAME OF SKILL

BACKGROUND OF THE INVENTION

1. Field of the Invention

This invention relates to a game of skill and more particularly to a game of skill adapted to require an intuitive insight as to the solution of the game as well as requiring sufficient hand-eye coordination and manipulative skill, and in one form, requires the solution on the game within a given time period.

2. Description of the Prior Art

Games known in the art have generally dealt with the removal or placement of individual sticks or the like order to play the game utilizing said sticks or the like. In one particular game, numerous sticks are disbursed upon a playing surface and them individually removed, the primary object being to remove said sticks without moving adjacent sticks. The individual winner. The game, although requiring a certain amount of dexterity and hand-eye coordination skill does not require any intuitive reasoning prior to removal of the game objects.

A variation of the prior game of removing sticks from a disbursed pile is discussed in Semple, U.S. Pat No. 2,039,121, issued Apr. 28, 1936. Semple discloses a game having a base which includes an upright member. A number of geometrically formed pieces are placed horizontally upon a surface of the base and must be properly balanced or they will fall from the balancing base.

Other forms of prior art games utilize a plurality of object playing pieces which are either sequentially added to or removed from a support structure in compliance with the instructions for playing said games. The prior art games, although requiring a certain amount of hand-eye skill coordination and manual dexterity do not require a challenge of one's mental ability in solving the object of the game without provision of instructions for playing the game. The prior art games have no time limitation element as an integral part of the game structure or playing requirement.

SUMMARY OF THE INVENTION

A primary object of the invention is to provide a game and method for playing the game, requiring physical skill and coordination for its use.

A second object of the invention is to provide a game in which a significant amount of intuitive skill is required for the solution of the game puzzle.

Another object of the game device is to provide a challenging game utilizing a small number of individual parts required for the playing of the game.

Still another object of the game device is to provide a game for one person in which the solution must be completed within a given time period.

Yet another object of the invention is to provide a novel game which may be played individually or in opposition with more than one player, the winner being determined based upon time elapsed to solve the puzzle.

Other objects, features, and advantages of the invention will be apparent from the following detailed description taken in conjunction with the accompanying drawings showing preferred embodiments of the invention.

The game of the present invention comprises a base menber, at least two, substantially rigid connecting members and a substantially rigid manipulative member, all for use in combination. The base has at least two spaced apart slots in a base face and each of the connecting members has a first end to cooperate with a slot to releasably retain the first end within the slot. The connecting members also include a second portion, remote from the first end, one of the second portions being shaped in a bend.

In a preferred form, the game includes a timing device positioned in the base, for example, having a sweep timing arm adapted to sweep around an area of the base face to initiate and terminate play of the game.

The method of the present invention for playing such a game includes erecting a structure defined by the base and the connecting members which are disposed together above the base at their second portions. The structure is moved by the manipulating member to form an interlock and then is raised from the base.

DESCRIPTION OF THE PREFERRED EMBODIMENT

Figure 1:
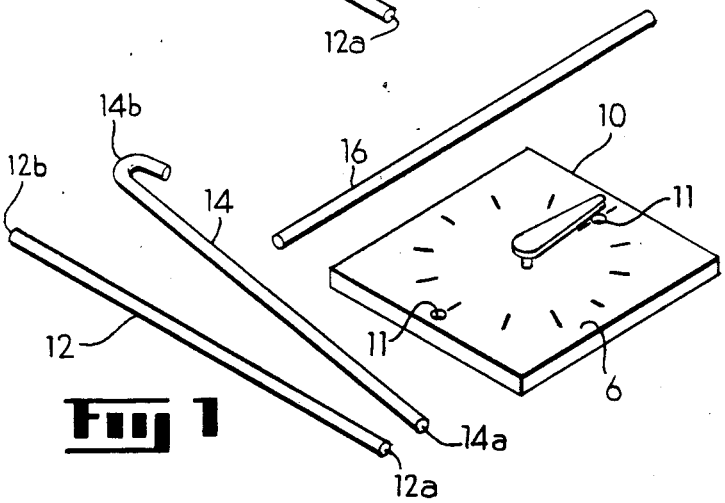
FIG. 1 is a perspectve view of the individual elements comprising one form of the game of the invention.

Referring more particularly to the drawings, like numbers refer to like parts in each view. FIG. 1 shows the individual members of the game wherein there is provided a base 10 containing slots 11 for the acceptance of connecting game members 12 and 14. As used herein, the term "slot" is intended to include within its meaning any appropriate hole, depression, indentation, etc. of a size and shape to enable releasable retention therein of an end of a connecting member. Connecting game members 12 and 14 are provided in substantially rigid form and of convenient cross sectional shape. For example, they may be of a uniform circular cross section, or other shape such as rectangular, square, triangular, etc.

Figure 2:
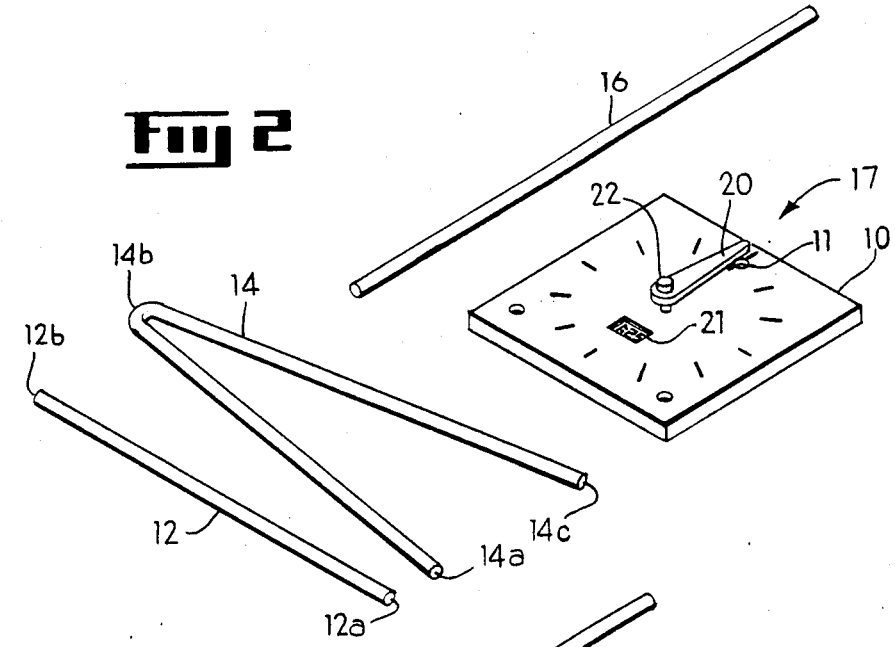
FIG. 2 is a perspective view of the individual elements comprising another form of the present invention.

Connecting game members 12 and 14 each have a first end **12*a* and 14*a* in FIG. 1, and 12*a* and 14*a* and 14*c* in FIG. 2, adapted to cooperate with a slot 11 to releasably retain the first end within the slot. In addition, each such connecting member has a second portion, 12*b* and 14*b* respectively, remote from the first portion and intended to cooperate in an interlock, to be described below. Accordingly, the second portion 14*b* includes a bend sufficient to entrap a second portion of the other connecting members, for example, 12*b* in the embodiment of the drawings. In FIG. 1, first member 14 includes a hook-like bend at 14*b* and is a more simple structure than the first member 14 in FIG. 2 which includes a sharp bend at 14***b*, sometimes referred to as a "V" shape for simplicity of expression.

In FIG. 2, connecting game member 14 consists primarily of two substantially rigid leg portions formed to provide a sharp bend or a "V" by an appropriate bending or joining means at the apex of the bend or "V" shape. In the embodiment of FIG. 2, the planner heights of the double-legged connecting game member 14 is substantially the same as the length of the more simple connecting game member 12. It is to be understood that the double-legged game member 14 may be formed from a continuous, preferably and conveniently uniform circular cross section, rod or the like by mechanical forming. A manipulative game member 16 is provided in substantially rigid form, preferably and conveniently of uniform circular cross section, and generally of longer length than the game member 12. It is also understood that the game members 12, 14 and 16 respectively may be formed of a variety of materials such as metal, wood, plastic, etc.

Referring particularly to FIG. 2, base 10 has as an integral part of and in a face of said base a timing device with a clock face shown generally at 17. Said timing device has a sweep timing hand or arm 20 and an on/off switch 22..

Figure 3:
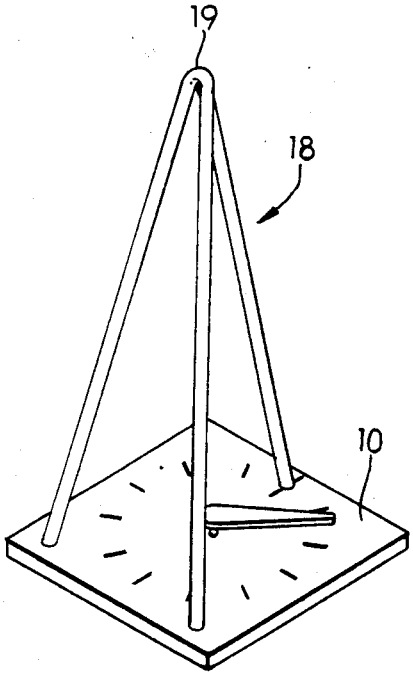
FIG. 3 is a perspective view of a portion of the elements comprising the invention of FIG. 2 forming a substantially erect tripod structure standing upon a base.

To prepare the game for play , the single-legged game member 12 and the double-legged game member 14 of FIG. 1, are positioned upon base member 10 by placing first or free ends 14*a* and 14*c* of the double-legged game member in two of the slots 11 and the placing the first end 12*a*, which can be either end of the single-legged game member 12 in the remaining slot 11. Then the second portions 12*b* and 14*b* of the game members 12 and 14, respectively, are brought together and balanced at a junction point 19 above and separated from base 10. The second portions are the furthest from base member 10 and are positioned in a resting mode to erect and form a free-standing pyramidal structure 18, as shown in FIG. 3. It is preferable for stability that the base of the pyramidal structure form an equilateral triangle such that when the double-legged game member 14 is placed in two slots it may be any two of the three available for placement. However, it is understood that it is not necessary for the operation of the present invention to form an equilateral triangle at the base of the pyramidal structure formed by the placement of the single-legged game member 12 and the double-legged game member 14.

In order to operate the game of the present invention, it is required to lift all three legs of the pyramidal structure 18 generally simultaneously with the manipulative game member 16 such that the pyramidal structure 18 is raised from the base 10 in a manner designed to elevate the three members in the pyramidal structure using the manipulative game member 16.

Timing device 17 in the embodiment of the drawings, shown for clarification in FIG. 2, includes a sweep timing arm or hand 20 adapted to sweep around an area of the face of base 10. The relative position of the slots 11 in which the first ends 14*a* and 14*c* of member 14 are placed in base 10, the position of timing arm 20, and the slot 11 in which first end 12*a* of member 12 is placed in base 10 is such that sweep timing hand 20 will not contact either portion of double-legged member 14, but will contact single-legged member 12 in such a manner as to destroy the balanced, free standing pyramidal structure 18 of the game puzzle if not solved within the required time. The required time will generally be the time required for sweep timing hand 20 to complete a 360 degree travel. If the puzzle is solved, by lifting the structure before the sweep timing hand 20 completes its travel, the on/off switch 22 can be operated to stop the hand thereby providing the player with a bench-mark standard for subsequent efforts to solve said puzzle in a better time by that player or a second player.

Figure 4:
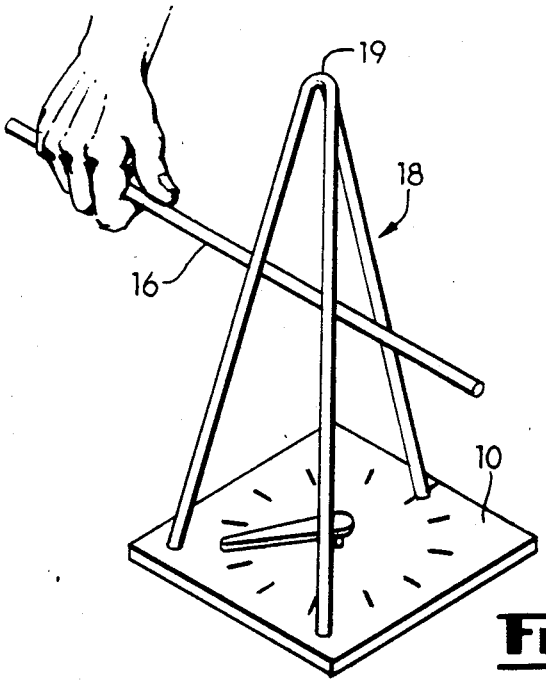
FIG. 4. is a perspective view of the embodiment shown in FIG. 3 with an additional element shown placed therein between during one of the first steps in solving the puzzle of the game.

In order to solve the game puzzle of the present invention, it is necessary to insert manipulative member 16 through the planes of the pyramidal structure 18 as shown in FIG. 4. The manipulative game member 16 will pierce the planes formed by the single-legged game member with each of the legs of the dpuble-legged game member. In the embodiment shown, it is not necessary that the manipulative game member 16 pierce the planes formed by the single-legged game member 12 and the separate legs of the double-legged game member 14 in a normal manner. The manipulative game member 16 may pierce the described planes in any manner sufficient to insert the manipulative game member fully within the confines of the space formed by the pyramidal structure.

Figure 5:
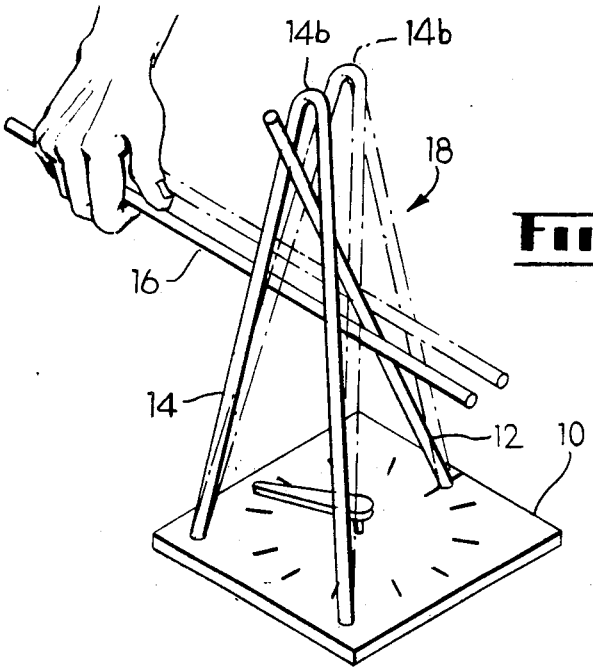
FIG. 5 is a perspective view showing an initial movement in the method of solving the puzzle.

After such insertion of the game member 16, said manipulative game member is caused to contact, either simultaneously or individually, the individual legs of the double-legged member 14 within the confines of the pyramidal space, FIG. 5. Further, the game member 16, after said contact, is used to gently force the double-legged game member 14 in a direction generally away from the single-legged game member 12 until the second portion 12*b* of single-legged game member 12 shifts position, falling away from juncture portion 19 and toward manipulative game member 16, and causing contact between the single-legged game member 12 and the manipulative game member 16 within the confines of the pyramidal space, FIG. 5.

Figure 7:
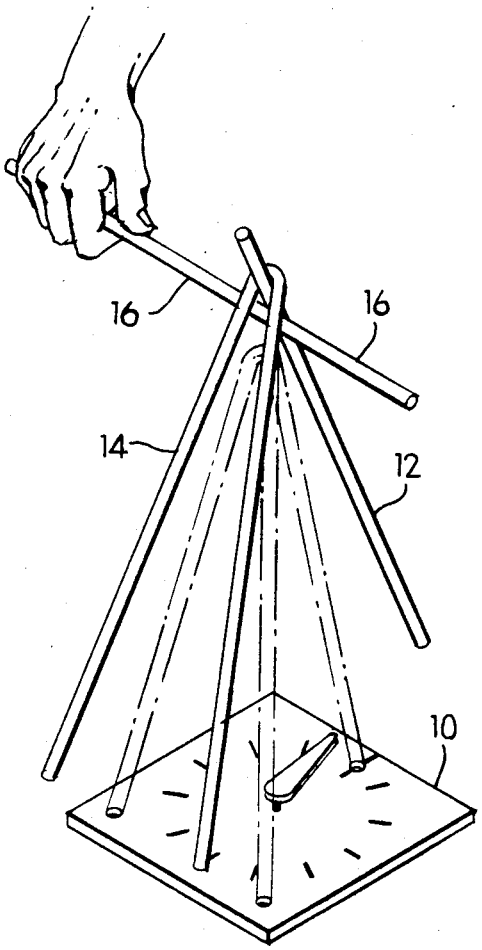
FIG. 7 is a perspective view of the final step in the solution of the puzzle.
Figure 6:
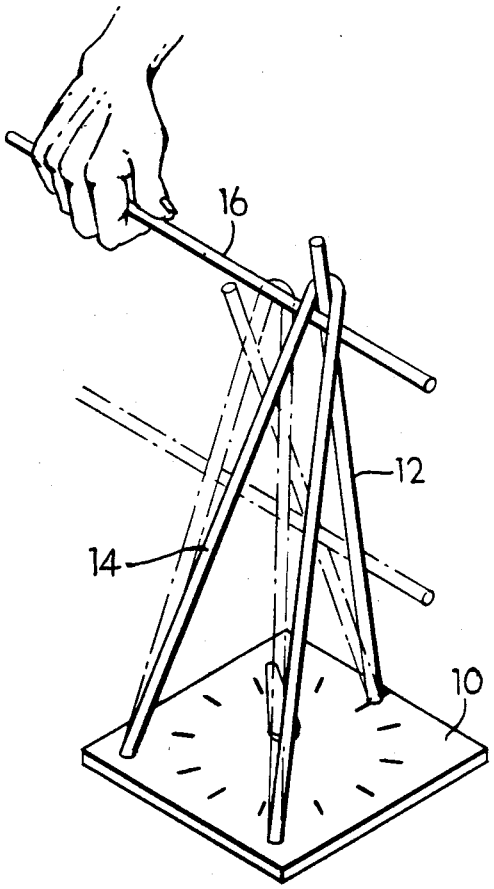
FIG. 6 is a perspective view showing a further step in the solution of the puzzle.

The manipulative game member 16 is then used to allow the single-legged game member to slidably move along game member 16 and between the individual leg members of the double-legged game member 14 such that it will reach a point where the double legged game member 14, the single-legged game member 12, and the manipulative game member 16 will come together in a juxtaposition approximating the apex of the original pyramidal structure, as shown in the sequence of FIGS. 5, 6 and 7.

The game member 16 is then slowly raised, generally contacting the inner portions of both the single-legged and double-legged game member, slidably moving the single-legged game member to a contact point within the double-legged game members' individual leg portions, generally at second portion 14*b*, causing an interlocking, entrapping network between the single-legged member 12, the double-legged member 14 and the manipulative game member 16, FIG. 6. At the point when the interlocking network is formed, the member 16 is continually raised until the entire pyramidal structure is lifted in a direction generally upward from base 10 and the first ends 12*a*, 14*a* and 14*c* are removed from the base portion slots 11, FIG. 7.

If the game is properly completed within the required time the on/off switch 22 is activated to cut off movement of timing sweep arm 20. If the game is not properly completed within the require time, the sweep timing arm 20 will complete its 360 degree travel, contact the lower portion of the single-legged member 12 generally causing the entire pyramidal structure 18 to tumble. At such time the player's turn is over.

In order to continue and complete the game, the above described steps essentially are reversed such that the end 12*a* of single-legged game member 12 is positioned within its retaining slot 11 within the base member and the remaining structure manipulated until the ends 14*a* and 14*c* if double-legged game portion 14 is placed within its retaining slots 11 within the base member 10. Continuing the reverse movement, the second portions 12*b* and 14*b*, respectively of the single-legged game member 12 and the double-legged game member 14 are returned to their original positions and the manipulative game member 16 is removed from within the pyramidal structure formed by the single-legged and double-legged game members, 12 and 14 respectively.

In order to complete the game the timing device can be eliminated, reset, or used such taht the entire game must be completed within one sweep of timing arm 20. Variations can be appreciated based upon the level of skill of the players.

The primary manipulative game member 16 and the single and double-legged game members 12 and 14, respectively, may be conveniently made from a heavy gauge wire, plastic, rubber, or rubber coated wire or from any appropriately strong and rigid material capable of being joined or formed, for example, so as to form the double-legged game member 14. The base 10 may be made of wood, glass, metal, plastic or any other appropriate supportive material. The timing device 17 may be any appropriate timing device capable of measuring time within its face or said timer may be connected to a digital time readout 21 on base 10, activated by on/off switch 22. In addition the number of connecting members, such as 12 and 14, and their associated slots in base 10 can be increased to increase the degreee of difficulty of the game. It is understood that the invention is not confined to the particular construction, the particular method of solving the puzzle, or confined to the particular construction, materials, and arrangement of parts herein illustrated and described. Instead, it embraces all such modified forms thereof which come within the scope of the following claims.

I claim:

1. A game comprising:

a base member having at least two spaced apart slots in a base face;

at least two distinct, substantially rigid connecting members, each having a first end adapted tp cooperate with a slot to releasably retain the first end within the slot and a second portion remote from the first end;

a first of said connecting members having a second portion shaped in a bend sufficient to entrap a second portion of the remainder of said connecting members at a position remote from the base member; and, a substantially rigid manipulative member.

2. The game of claim 1 in which the base member includes a timing device positioned in the base.

3. The game of claim 2 in which:

the timing device includes a sweep timing arm adapted to sweep around an area of the face of the base; and, one of the slots is positioned in the face within the area of sweep of the arm.

4. The game of claim 3 in which the timing device includes a timing chart and an on/off switch associated with the sweep timing arm.

5. The game of claim 2 in which the timing device includes an on/off switch and digital read-out device operatively connected with the on/off switch for timing determination.

6. The game of claim 2 in which:

the base includes three sots substantially positioned as if at corners of an equilateral triangle;

the connecting members consist of the first connecting member having a pair of first ends adapted to cooperate with two of the three slots and a second portion intermediated the pair of first ends and formed in a relatively sharp bend, and another connecting member having a first end adapted to cooperate with the third of the three slots.

7. The game of claim 6 in which:

the timing device includes a sweep timing arm adapted to sweep around an area of the face of the base; and, one of the slots is positioned in the face within the area of sweep of the arm.

8. The game of claim 6 in which the timing device includes a timing chart and an on/off switch associated with the sweep timing arm.

9. A method of playing the game of claim 1 comprising the steps of:

providing the base member, the connecting members and the manipulative member;

erecting a structure defined by the base and connecting members by disposing the first ends of the connecting members in the slots and the second portions of the connecting members together at the bend of the first of the connecting members to define a juncture point;

inserting the manipulative member within the structure between the juncture point and the base;

moving the connecting members with the manipulating member to form an interlock therebetween; and then, raising the interlocked members to remove the first ends from the slots and from the base member.

10. A method of playing a game as in claim 9 wherein after having raised said members the members are replaced in their original position in the base member.

11. The method of claim 9 for playing a game in which the base member includes a timing device, wherein:

the timing device is started to begin the game, and;

the interlocked members are raised before the timing device reaches a preselected time.

12. The method of claim 9 for playing a game in which the base member includes a timing device having a sweep timing arm adapted to sweep around an area of a face of the base, and one of the slots is positioned in the face within the arm sweep area, wherein:

the arm of the timing device is started in its sweep to begin the game; and, the interlocked members are raised before the arm reaches the position of the slot within the arm sweep area.

* * * * *